United States Patent [19]

Bernhardt

[11] 4,163,554

[45] Aug. 7, 1979

[54] GOLF PUTTER

[76] Inventor: Floyd V. Bernhardt, 5532 N. High School Rd., Indianapolis, Ind. 46254

[21] Appl. No.: 834,508

[22] Filed: Sep. 19, 1977

[51] Int. Cl.[2] ..... A63B 53/02

[52] U.S. Cl. ..... 273/80 C; 273/81 B; 273/167 G

[58] Field of Search ..... 273/80 C, 81 R, 81 B, 273/81 D, 81.3–81.6, 167–175, 164, 77 R, 80.2; D34/5 GC, 5 GH

[56] References Cited

U.S. PATENT DOCUMENTS

| | | | |
|---|---|---|---|
| D. 203,756 | 2/1966 | Norwood | 273/167 G X |
| D. 213,507 | 3/1969 | Koenig | 273/80 C X |
| D. 223,031 | 2/1972 | Ernst | 273/167 G X |
| D. 235,272 | 6/1975 | Quast | 273/167 G X |
| D. 235,564 | 6/1975 | Cook | D34/5 GH |
| D. 235,568 | 6/1975 | Cook | D34/5 GH |
| D. 236,517 | 8/1975 | Cook | D34/5 GH |
| D. 246,329 | 11/1977 | Little | 273/167 J X |
| 1,213,014 | 1/1917 | Rees | 273/81 D |
| 1,250,296 | 12/1917 | Fitzjohn et al. | 273/167 G X |
| 2,133,695 | 10/1938 | Hall | 273/81 R |
| 3,062,549 | 11/1962 | Duden | 273/81.3 |
| 3,064,975 | 11/1962 | Smith | 273/80 C |
| 3,077,350 | 2/1963 | Koorland | 273/167 G X |
| 3,085,804 | 4/1963 | Pieper | 273/167 B X |
| 3,198,520 | 8/1965 | Ahmuty | 273/81.4 |
| 3,219,348 | 11/1965 | Dishner | 273/77 R |
| 3,319,962 | 5/1967 | Summers | 273/167 G X |
| 3,387,845 | 6/1968 | Raub | 273/167 F X |
| 3,392,977 | 7/1968 | DeLacey | 273/168 |
| 3,448,981 | 6/1969 | Anweiler | 273/167 G X |
| 3,486,755 | 12/1969 | Hodge | 273/164 |
| 3,539,184 | 11/1970 | Koorland | 273/80 C X |
| 3,549,300 | 12/1970 | Pelz | 273/80 C X |
| 3,574,349 | 4/1971 | Kropp | 273/167 G X |
| 3,606,326 | 9/1971 | Sparks et al. | 273/81 R |
| 3,652,093 | 3/1972 | Reuter | 273/169 |
| 3,679,207 | 7/1972 | Florian | 273/81 A |
| 3,758,115 | 9/1973 | Hoglund | 273/167 G X |
| 3,989,257 | 11/1976 | Barr | 273/175 |
| 4,063,733 | 12/1977 | Benedict | 273/80 C |

FOREIGN PATENT DOCUMENTS

| | | | |
|---|---|---|---|
| 6763 | 4/1933 | Australia | 273/81.4 |
| 474058 | 10/1937 | United Kingdom | 273/81 B |

OTHER PUBLICATIONS

"Golf World", Jan. 4, 1972, p. 36.
"Golf World", Jun. 19, 1964, p. 4.

*Primary Examiner*—Richard J. Apley
*Attorney, Agent, or Firm*—Woodard, Weikart, Emhardt & Naughton

[57] ABSTRACT

A golfing putter for putting in a modified croquet style includes an elongated shaft having an upper grip portion and a lower grip portion and a putter head at the lower end having a striking face. The shaft is joined to the head by means of a connecting neck portion and the primary longitudinal axis of the shaft which diverges from the vertical axis of the head is also at an angle to the striking face. Due to this arrangement and the elongated shaft, the user is able to stand in a substantially upright position with the golf ball out in front of the user's body. By holding the upper grip portion as a pivot point with one hand, the other hand draws the clubhead back in a pendulum swing type of motion. Release by this other hand allows the club to swing downward thereby striking a golf ball. Kinetic energy of the clubhead is imparted to the ball thereby causing it to travel in a particular direction with a rolling motion, the attitude of the striking face upon impact with the ball tending to impart a slight topspin to the ball.

23 Claims, 21 Drawing Figures

GOLF PUTTER

BACKGROUND OF THE INVENTION

1. Field of the Invention

The present invention relates in general to an apparatus for imparting rolling motion to a spherical object and directing said object along a desired path, and more particularly to a golfing putter for putting a golf ball.

2. Description of the Prior Art

There are a great variety of golfing putters available to those who play the game of golf. Although different weights and clubhead configurations exist, traditionally most golf putters are constructed so that the golfer is required to stand perpendicular to the intended line of travel of the ball and to bend well over the ball while stroking. Examples of such types of conventional putters are disclosed by the following U.S. Patents:

| U.S. Pat. No. | Patentee | Issue Date |
|---|---|---|
| 3,574,349 | Kropp | 4/13/71 |
| 3,652,093 | Reuter | 3/28/72 |
| 3,679,207 | Florian | 7/25/72 |
| 3,989,257 | Barr | 11/02/76 |

Although the Florian putter is shown as being used in a croquet style by the golfer, the clubhead and shaft relationship is conventional. Unfortunately, these conventional putters have presented difficulties to both amateur and professional golfers. To coordinate the golfer's stance, eyesight alignment, clubhead movement, and clubhead angle at impact so that the ball moves along its intended path for the desired distance, takes many hours of practice in order to achieve even marginal success. In an effort to make "lining-up" of a putt somewhat easier, certain golfers have preferred to use a croquet-style putter. This style allows the golfer to stand with one foot positioned on each side of a line coincident with the intended path of travel for the ball and to sight directly through the ball rather than standing at a right angle and slightly perpendicular to the intended path. However, in accordance with the "1977 Rules of Golf" as approved by the United States Golf Association (USGA), any putter which is intended to be "legal" for USGA sanctioned play shall be designed such that "the axis of the shaft from the top to a point not more than five inches above the sole shall diverge from the vertical by at least 10 degrees in relation to the horizontal line determining length of head." Consequently, unless a putter is designed with this side angle of at least 10 degrees, a feature conventional croquet-style putters do not have, it will not be a "legal" putter. The USGA rules also require that the golfer stand to one side of the intended path rather than being positioned such that a line extension of this intended path is located between the feet.

Examples of prior art devices which have come to my attention during my review of putter styles and which are typical of currently "illegal" designs are disclosed by the following U.S. patents:

| U.S. Pat. No. | Patentee | Issue Date |
|---|---|---|
| Des. 203,756 | Norwood | 2/15/66 |
| 3,062,549 | Duden | 11/06/62 |
| 3,319,962 | Summers | 5/16/67 |
| 3,387,845 | Raub | 6/11/68 |

-continued

| U.S. Pat. No. | Patentee | Issue Date |
|---|---|---|
| 3,486,755 | Hodge | 12/30/69 |

A further reference disclosing a putter having an "illegal" design is shown in "Golf World" magazine of June 19, 1964 on page 4.

In order to achieve the advantages of a croquet-style of putting and in order to conform to the current USGA rules, a putter shaft would have to be arranged such that it angled to the side by at least 10 degrees off of vertical as well as angled to the rear (away from the ball-striking putter face). Applicant is unaware of any putter designed in such a fashion.

As mentioned previously, one advantage of the croquet-style putter is that it enables the golfer to stand so that his line of sight is through the ball and coincident with the intended path of travel of the ball. However, since the golfer must stand to the side of this intended path of travel, one way that sighting in the manner described can be accomplished is to stand so that the feet, positioned behind the ball, are pointed in a direction parallel to this intended path and to lean to the side so that the golfer's head extends over the intended path of travel. Such a stance could be established irrespective of the putter used, but due to clubhead weight and balancing, most conventional putters swung from this stance will not perform acceptably and current croquet-style putters which are preferred for such a swing are illegal. A related problem to achieving the stance described above, is that with the use of a standard length putter, the golfer must bend at the waist a significant degree in order to be able to grip the club shaft. The contortions of standing to the side, bending well over and leaning to the side place the golfer in an unnatural and awkward position. In this position, it is difficult for the golfer to remain steady, a requisite for any good putting stroke. To avoid the need to bend at the waist, putters have been designed with elongated shafts, such as disclosed in the "Golf World" reference and by the prior Florian patent. However, although Florian discloses a golf putting technique which is similar in appearance to a "legal" croquet-style of swing, there are disadvantages with this design. The shaft in Florian is offset at a 10 degree angle to the side relative to the line of intended travel of the ball, but the shaft is not bent to the rear as a croquet-style putter is bent. The stance of the golfer makes it difficult to sight through the ball, as the golfer's eyes are not in line with the ball and the hole. As the club is drawn back, the 10 degree offset causes an arc to be swept around the golfer's body, and when the downward swing occurs, the clubhead control and a true pendulum motion are difficult to achieve.

A final feature of putters in general, and in particular putters having elongated shafts, is that the "feel" of the club as transmitted through the grips to the golfer's hands is important for control and accuracy. The farther the hands are placed from the point of impact to the ball, the more difficult the control of the putt. Thus, the "Golf World" reference and the Florian patent, which disclose elongated shafts, also disclose two gripping portions, the lower portion providing a gripping location closer to the point of impact. An equally important feature is the material used for the gripping portions. If the material is too soft or too hard, it may not transmit the necessary feel to the hands. It is preferred that putters which have the two gripping portions and which are swung in a croquet style, be pivoted by the hand on the upper grip and guided by the hand on the lower grip. Thus it would be an improvement to the prior art to construct the upper gripping portion out of a relatively soft, synthetic material enabling a secure and firm hold on the putter shaft, and the lower gripping portion to be constructed out of a harder synthetic material for greater sensitivity to the clubhead movement and ball impact. U.S. Pat. No. 1,213,014 issued to Rees also discloses a golf club shaft having two distinct grips. However, the purpose of these two grips is to allow the club swing to be controlled by selected fingers and for the other fingers to have virtually no effect as to this control. Rees does not disclose the use of the two grips for creating and controlling a croquet-style putting swing.

Inasmuch as applicant's invention makes reference in part to golf club grip designs and to clubhead designs as they relate to a "legal" croquet-style golf putter, the following patents are cited as pertaining to such features:

| U.S. Pat. No. | PATENTEE | ISSUE DATE |
|---|---|---|
| 2,133,695 | Hall | 10/18/38 |
| 474,058 | Tingey (Great Britain) | 10/25/37 |
| Des 236,517 | Cook | 8/26/75 |
| Des 235,564 | Cook | 6/24/75 |
| Des 235,568 | Cook | 6/24/75 |
| 3,077,350 | Koorland | 2/12/63 |
| 3,539,184 | Koorland | 11/10/70 |

A further clubhead design is shown by the advertising brochure of Chad Industries describing the "Nassau Perfect Putter". This brochure cites U.S. Pat. Nos. 3,758,115 and Des. 228,929 as applying to the product.

With respect to the various clubhead designs which are shown by these references, it is noted that none of the Cook or the Koorland patents show a shaft which exits from the approximate center of the clubhead in order to provide a more balanced club. Furthermore, none of the clubhead designs, including the "Nassau Perfect Putter" reference, show a shaft which both diverges from vertical (as per the "1977 Rules of Golf") for a legal design and bends to the rear in order to permit a croquet-style of putting.

The golf club grip designs shown by Hall and Tingey relate to grip construction and surface contouring respectively. Hall discloses a method of grip construction to produce a grip design which is intended for an overlapping style of grip. The concept is based on the use of grip materials having different coefficients of friction in order to reduce the effects of turning or twisting and to permit the guiding of the left hand to be unimpeded by the right hand. There is no mention in Hall of the use of separate gripping portions of different durometer hardness and different contours in order to provide a firm grip at one location and a sensitive feel at the other location. The Tingey patent discloses a grip design which incorporates a cavity for receiving the golfer's thumb. Such a design is suggestive of various club grip styles which have been disapproved by the USGA and which are shown on page 60 of the "1977 Rules of Golf".

SUMMARY OF THE INVENTION

A golf putter according to one embodiment of the present invention comprises an elongated shaft and a clubhead connected to the elongated shaft. The elongated shaft has upper and lower gripping means and a primary longitudinal axis. The clubhead has a sole, a ball-striking surface and a vertical axis. The vertical axis is perpendicular to the sole and lies within an axis plane which is perpendicular to the ball-striking surface. The ball-striking surface lies in a plane disposed at an angle of from 1 degree to 8 degrees with respect to the primary longitudinal axis which diverges from the clubhead vertical axis by at least 10 degrees.

One object of the present invention is to provide an improved golf putter.

Another object of the present invention is to incorporate the features of an elongated, offset shaft, croquet-style clubhead arrangement and special gripping means, in order to allow the golfer to stand in a substantially upright position with the golf ball in front and line up the club swing to the intended path with the golfer's eyes in line with the path and strike the ball in a manner to impart a slight topspin to the ball.

Related objects and advantages of the present invention will be apparent from the following description.

DESCRIPTION OF THE PREFERRED EMBODIMENT

Figure 1:
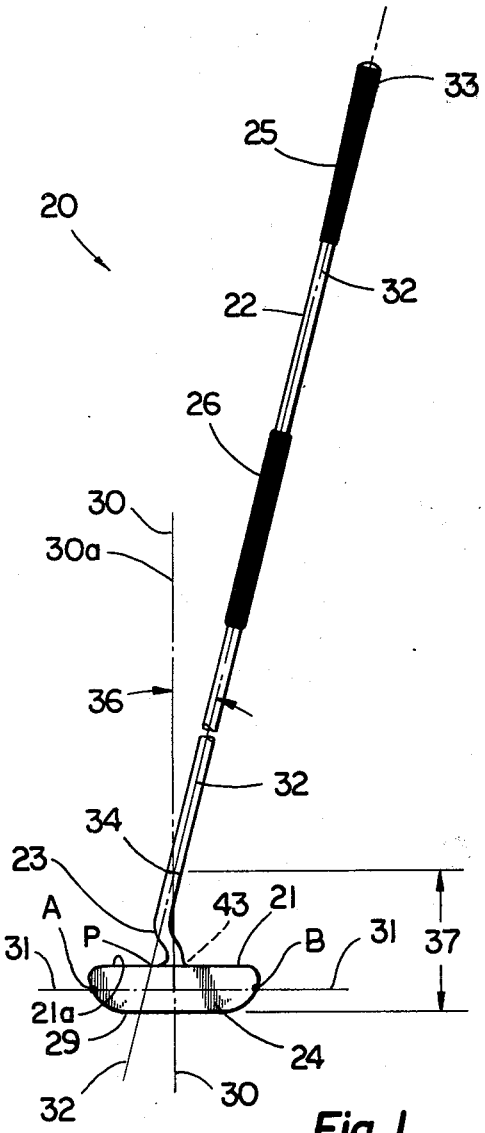
FIG. 1 is a front elevational view of a golf putter according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
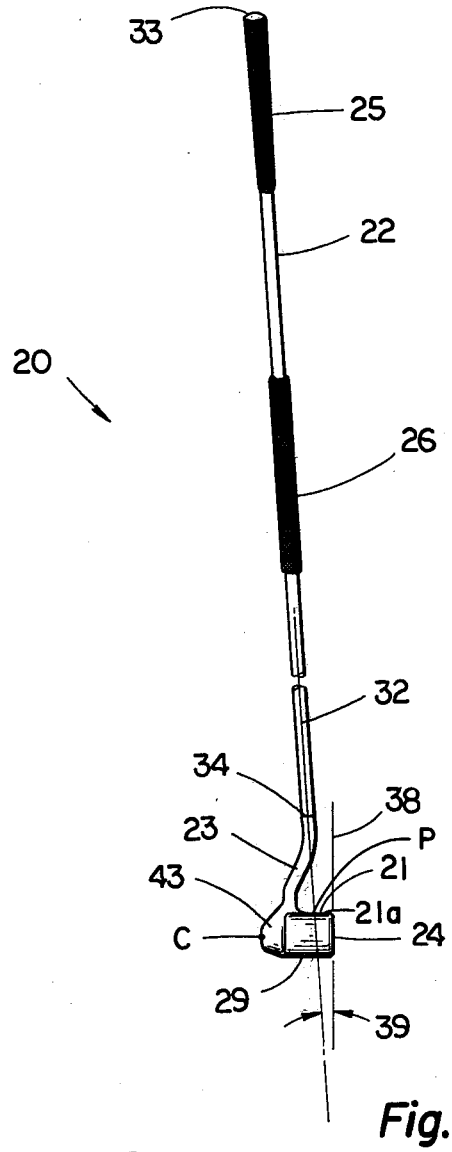
FIG. 2 is a side elevational view of the FIG. 1 golf putter.

Referring to FIG. 1, golf putter 20 is shown comprising clubhead 21, elongated shaft 22, connecting neck portion 23, ball-striking surface 24, upper grip portion 25 and lower grip portion 26. Clubhead 21 is generally oblong in outer contour shape and lower surface 29 in proper golfing terminology is referred to as the sole of the clubhead. Surface or sole 29 is substantially flat and is generally perpendicular to ball-striking surface 24 such that when sole 29 is parallel with the ground, ball-striking surface 24 has zero loft as is illustrated by FIG. 2. The length and breadth of the clubhead 21 are defined in accordance with United States Golf Association (USGA) rules, and although the exact dimensions may vary, the length shall be greater than the breadth. The disclosed putter measures approximately 2.95 inches between outermost points A and B and 1.10 inches between point C, the rearwardmost point on the clubhead, and surface 24 which is substantially flat (see FIG. 2). Axis plane 30 is coincident with the vertical axis 30*a* of clubhead 21, and axis plane 30 is perpendicular to ball-striking surface 24 and to a horizontal line 31 passing through points A and B. Axis plane 30 is approximately equidistant between points A and B, and vertical axis 30*a* lies within ball-striking surface 24. The primary longitudinal axis 32 of shaft 22, which is straight throughout its entire length, is represented by a line which is coincident with the geometric center of shaft 22 extending from free end 33 to point of attachment 34 where connecting neck portion 23 joins to shaft 22. The line extends beyond both ends of the putter in order to provide a suitable reference line for subsequent structural descriptions.

Point of attachment 34 also represents the point at which shaft 22 diverges from vertical axis 30*a* (and also axis plane 30). In accordance with USGA rules, angle 36 between the vertical axis 30*a* (axis plane 30) and the primary longitudinal axis 32 shall be at least 10 degrees. In the shown and possibly the preferred embodiment, this angle is 10 degrees. Furthermore, the USGA rules state that the point at which the shaft shell diverge (in this case point of attachment 34) from the vertical (axis) shall not be more than five inches above the sole. The length along vertical axis 30*a* from sole 29 to point of attachment 34, as indicated by arrowed line 37, is approximately 2.75 inches. The overall length of putter 20 as measured along vertical axis 30*a* from sole 29 to a point horizontal with free end 33 is approximately 42 inches.

Bell-striking surface 24 has been described as substantially flat and as such lies within a striking plane 38 which appears only as a line in FIG. 2. Primary longitudinal axis 32 which diverges from vertical axis 30*a* is inclined downwardly toward surface 24 and is disposed relative to plane 38 at an angle 39 of from 1 degree to 8 degrees. In the shown and possibly the preferred embodiment, this angle is 4 degrees. Vertical axis 30*a* is the line of intersection between axis plane 30 and plane 38.

Connecting neck portion 23 is shown as comprising an integral extension of clubhead 21 joining thereto at the top of rear protrusion 43. It is equally acceptable for the purposes of this application and for the design of the disclosed embodiment for neck portion 23 to join clubhead 21 at a point lower to sole 29 as well as at a point more forward toward plane 38. The effect of changing the location at which neck portion 23 joins to clubhead 21 will be to change the point of intersection of axis 32 with plane 38. However, the magnitude of angle 39 will not change so long as the shape of neck portion 23 remains the same. Rear protrusion 43 may be considered as part of the rear surface of clubhead 21 as well as part of neck portion 23 inasmuch as neck portion 23 is integral with and extends from the rear surface. Neck portion 23 attaches to the rear surface at a single location, the centerline of this single location being generally coincident with vertical axis 30*a* which is also coincident with the centerline of ball-striking surface 24. The contour of neck portion 23 is such that with shaft 22 attached to the free end of the neck portion at point of attachment 34, the primary longitudinal axis 32 intersects the top surface 21*a* of clubhead 21 at point P. Point P is between ball-striking surface 24 and the rear surface and between axis plane 30 and outermost point A.

Figure 6:
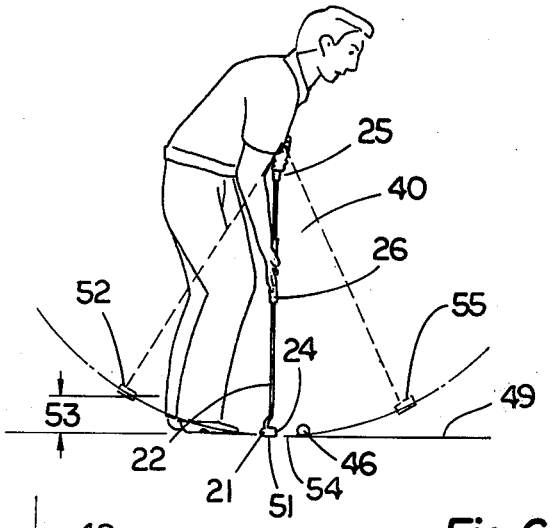
FIG. 6 is a side view of a golfer in a substantially upright stance indicating various clubhead positions.
Figure 7:
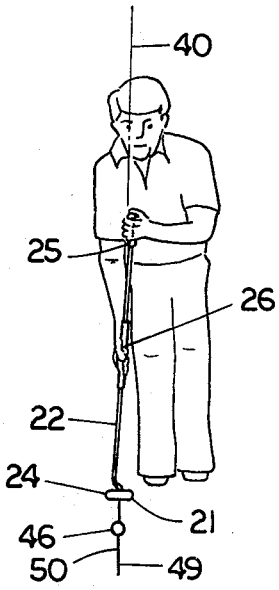
FIG. 7 is a front view of the FIG. 8 golfer.
Figure 8A:
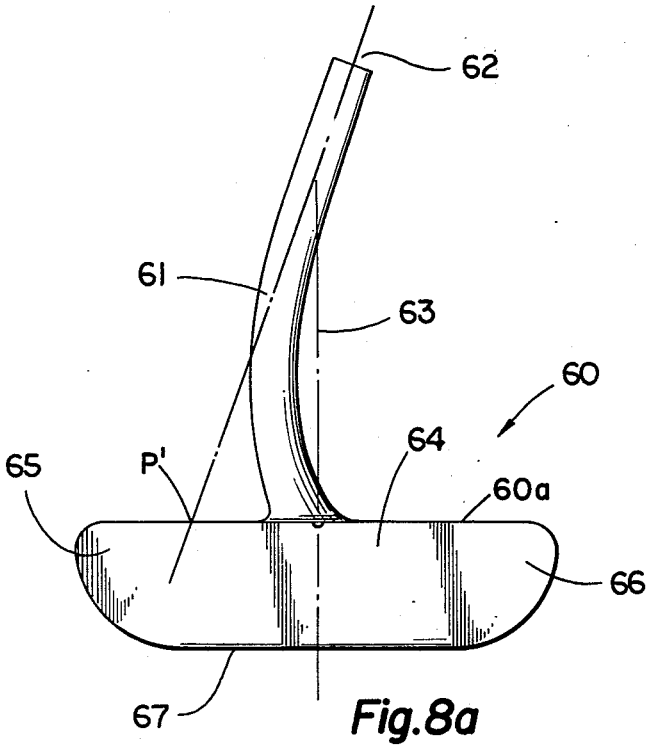
FIGS. 8*a*, 8*b*, 8*c*, 8*d* and 8*e* are front, side, top, back and bottom views, respectively, of an alternate clubhead design associated with the FIG. 1 golf putter.
Figure 8B:
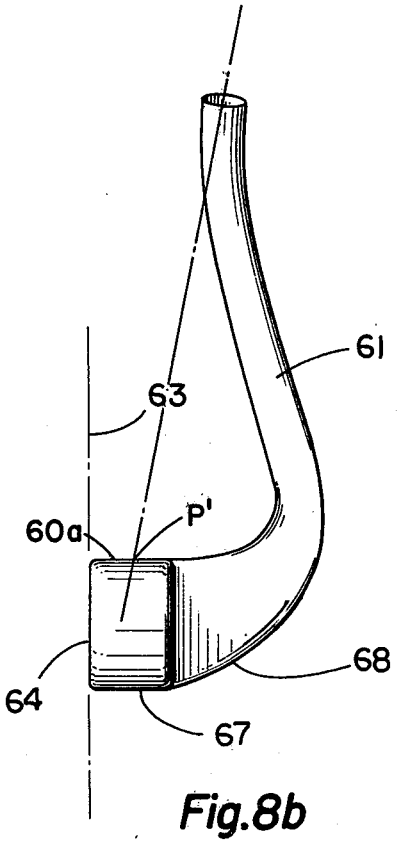
Figure 8C:
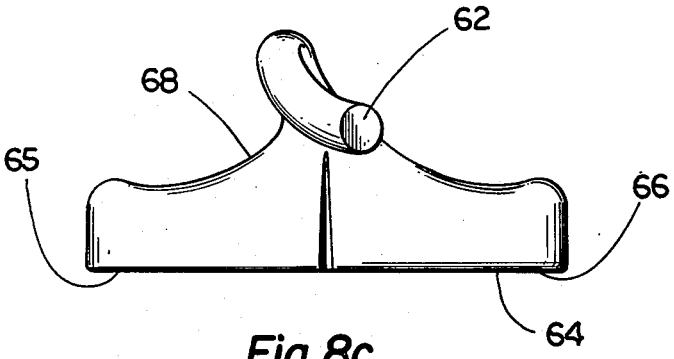
Figure 8D:
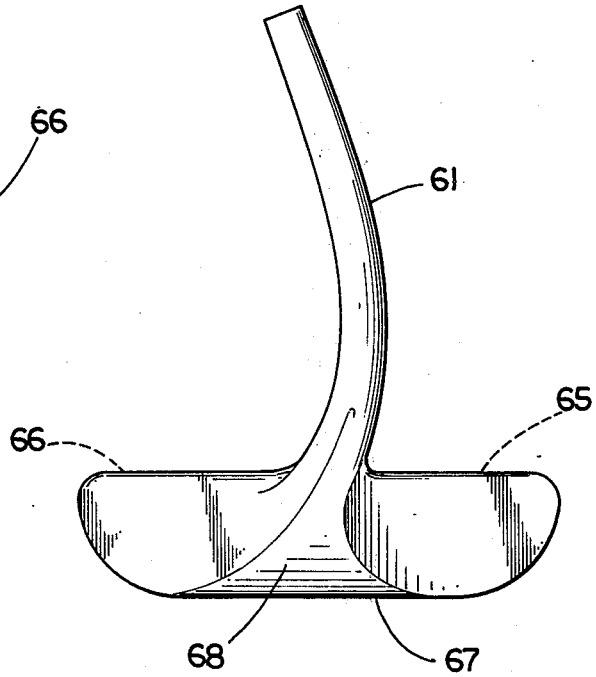
Figure 8E:
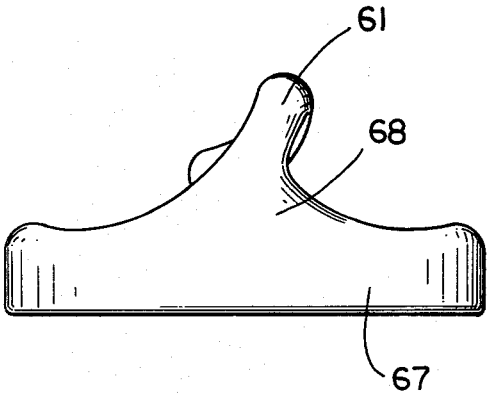
Figure 9A:
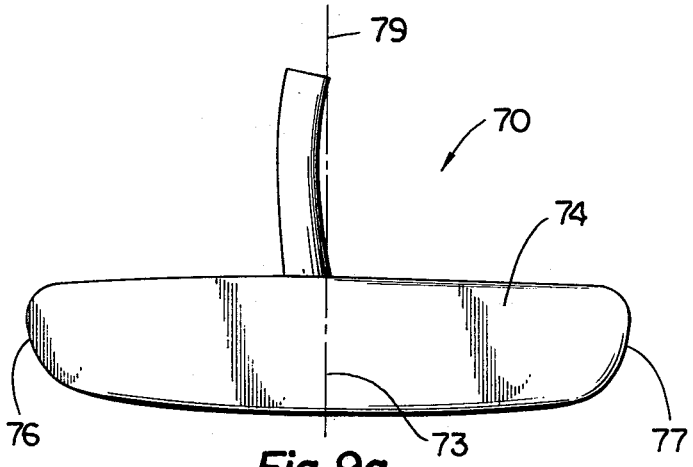
FIGS. 9*a*, 9*b*, 9*c*, 9*d* and 9*e* are front, side, top, back and bottom views, respectively, of another alternate clubhead design associated with the FIG. 1 golf putter.
Figure 9B:
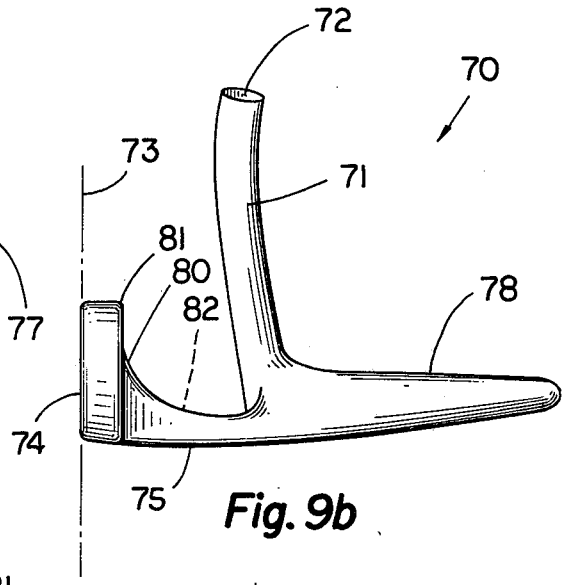
Figure 9D:
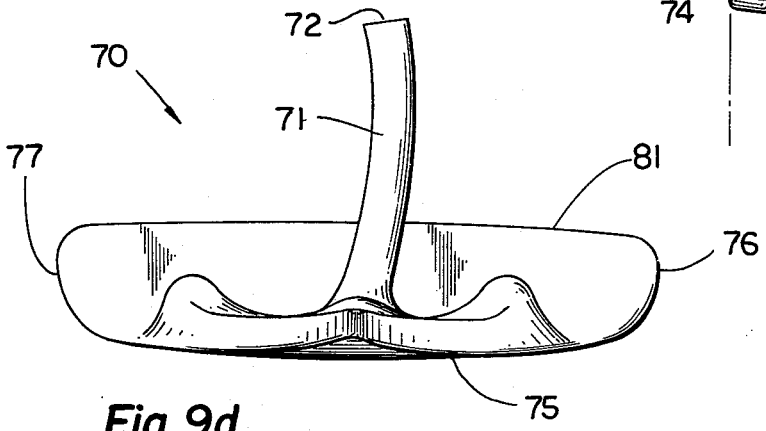
Figure 9E:
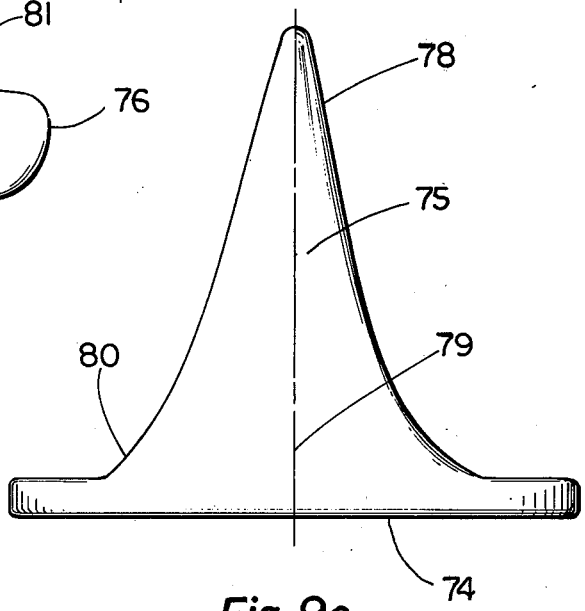
Figure 9C:
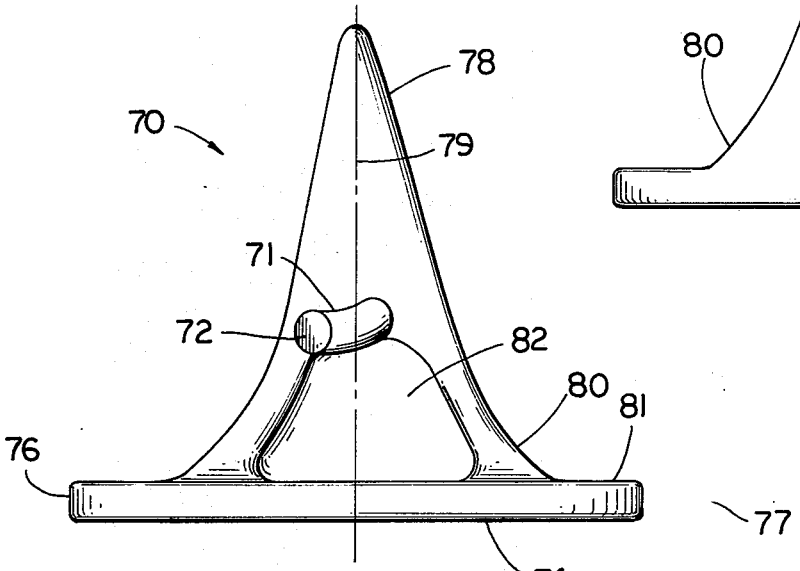

When putter 20 is swung in a pendulum-type of motion (descriptive of croquet-style putting), the plane of this motion is normal to plane 38 and coincident with the primary longitudinal axis 32 and the plane swept is a symmetry plane 40 (see FIGS. 6 and 7). Clubhead 21 is constructed and balanced in such a way that the center of gravity of clubhead 21 is in axis plane 30 and the center of gravity of clubhead 21 is behind the ball-striking surface. Ball-striking surface 24 extends equally in opposite directions from axis plane 30.

Figure 3:
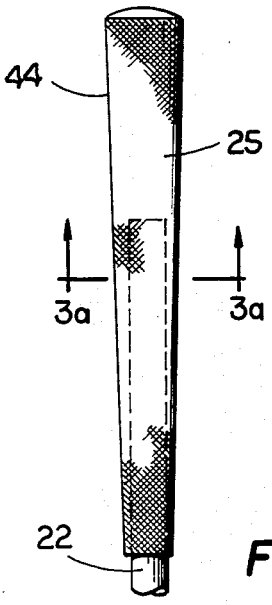
FIG. 3 is a detail of an upper gripping portion comprising a portion of the FIG. 1 golf putter.
Figure 3A:
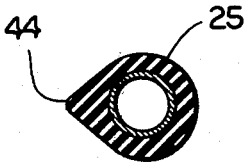
FIG. 3*a* is a sectional view of the upper gripping portion taken along line 3*a*—3*a* in FIG. 3.
Figure 4:
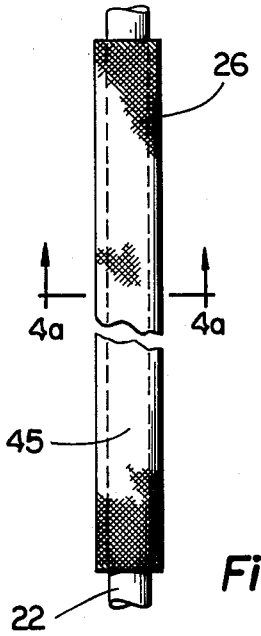
FIG. 4 is a detail of a lower gripping portion comprising a portion of the FIG. 1 golf putter.
Figure 4A:
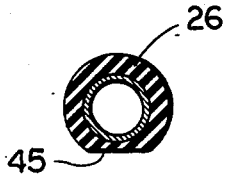
FIG. 4*a* is a sectional view of the lower gripping portion taken along 4*a*—4*a* in FIG. 4.

The upper grip portion 25, is shown in detail by FIGS. 3 and 3*a*. Portion 25 has a finger-orienting ridge 44 which assists the fingers in maintaining proper gripping alignment during the putting motion. FIG. 3*a* shows a cross section of upper grip portion 25 and ridge 44. The lower gripping portion 26 which is shown in detail by FIGS. 4 and 4*a* has a substantially flat front exterior surface 45 which assists in guiding the club during its downswing motion. FIG. 4*a* shows a cross section of lower gripping portion 26 and substantially flat front exterior surface 45. This flat front exterior surface 45 is positioned in a plane which is normal to the symmetry plane 40. Finger-orienting ridge 44 is turned to the side of shaft 22 and ridge 44 faces in a direction which is at a right angle to the direction front exterior surface 45 faces. Achievement of a true pendulum motion for the swing of the club is enhanced by the fact that virtually the entire weight of the club is below the pivoting point of the upper gripping portion.

Inasmuch as upper gripping portion 25 acts as the pivot point throughout the lining-up and stroking of the putt, it is important to the control and accuracy of the putt that this gripping portion be held firmly and comfortably with one hand, such as the left, and not be subject to turning, twisting, or slipping. To faciliate achieving this objective, upper gripping portion 25 is constructed of a relatively soft, synthetic material such as neoprene, or the like, with a Shore Durometer hardness of approximately 25. A suitable upper gripping portion could be a Golf Pride, "Pro-Only" style of grip offered by Eaton Corportion of Akron, Ohio. Being relatively soft, such a gripping portion is moderately compressible so that when gripped by the golfer's hand, the fingers will embed slightly into the surface thereby establishing a secure hold.

The design concept for the lower gripping portion 26 follows a slightly different approach. The lower gripping portion is initially held with the right hand, for example, while the putt is being lined-up and as the club is drawn back. However, on the downswing, the lower gripping portion is not actually held by the hand, but it is merely guided by the thumb of the hand. It is important that this thumb rest lightly on the substantially flat front exterior surface and maintain this surface, and thus the ball-striking surface, perpendicular to axis plane 30. In order to provide the lower gripping portion with the necessary "feel" so that the thumb is sensitive to deviations from this intended direction of motion, lower gripping portion is constructed of a relatively firm, synthetic material such as neoprene, or the like, with a Shore Durometer hardness of approximately 60. Such a material is weather-resistant and thus suitable for a golf club grip, and this material is able to be machined so that the flat exterior surface can be added.

The embodiment which has been described does not restrict the precise shape of the clubhead and a conventional, rectangularly-shaped clubhead would be appropriate for use with the shaft arrangement disclosed. Of course, the advantages of the shaft arrangement disclosed will be complemented by a clubhead which is specially shaped and balanced in order to produce a true and accurate stroke without the clubhead having a tendency to pull in or push out during its downward motion and upswing follow through. The clubhead designs of FIGS. 8*a*–8*e* and 9*a*–9*e* represent two such specially shaped and balanced clubheads which provide advantages in clubhead control and accuracy regardless of the shaft arrangement with which they are employed.

FIGS. 8*a* through 8*e* show a putter clubhead 60 in which a connecting neck portion 61, which is integrally formed as part of the clubhead, exits from the rear of the clubhead and extends upwardly with certain bends such that, when attached to a straight shaft at point 62, the shaft will diverge from the vertical axis 63 and will be disposed relative to ball-striking surface 64 as previously described for clubhead 21 and putter 20. Consequently, once the straight shaft is attached at point 62, the primary longitudinal axis 32 of the shaft will also intersect the top surface 60*a* of the clubhead at a point P' which is positioned between the ball-striking surface and the rear surface and between vertical axis 63 and the outermost end of the clubhead.

With conventional clubhead designs, as the end portions diverge upwardly from the sole, the mass of the clubhead of those end portions decreases and may result in a certain instability if the ball happens to be struck by the ball-striking surface at one of these outer locations. With the disclosed design, as end portions 65 and 66 diverge upwardly away from sole 67 (FIG. 8*d*), the thickness of clubhead 60 is gradually increased (FIG. 8*e*) so that any weight decrease due to diverging from sole 67 is compensated by increased thickness. Furthermore, neck portion 61 has a flared end 68 including the point of attachment to the rear of clubhead 60 and this flared end means of attachment provides a larger area of support, than is present with conventional putters, and thus the tendency of the clubhead to turn or twist if the ball is struck to one side of axis 63 is reduced by reducing any cantilever effects.

FIGS. 9*a* through 9*e* show another clubhead 70 in which the connecting neck portion 71 is integrally formed as part of the clubhead and extends upwardly from the approximate midpoint of the top surface of clubhead 70. Neck portion 71 is bent slightly such that when attached to a straight shaft at point 72, the shaft will diverge from the vertical axis 73 and will be disposed relative to ball-striking surface 74 as previously described for clubheads 21 and 60. Inasmuch as clubhead 70 is somewhat larger than conventional putters, the sole 75 covers a larger area. Therefore, to reduce the chances of "scuffing" the sole 75 prior to striking the ball, the sole is slightly tapered upwardly on the sides 76 and 77 and to the rear. Triangularly shaped protrusion 78 represents additional weight which is distributed equally on each side of axis plane 79 which includes vertical axis 73. In order to balance this weight over a larger area of ball-striking surface 74, the clubhead has a flared portion 80 which joins the rear part of the clubhead to upright portion 81. This larger area of attachment reduces any cantilever effects which tend to turn or twist the club when the ball is struck to one side of axis 73. In order to more uniformly distribute the total weight of the club, area 82, which comprises the majority of the triangularly shaped protrusion 78 between rear surface 81 and where neck portion 71 attaches, is relieved of material such that the thickness of area 82 is substantially reduced. The advantage of having greater clubhead weight, and in particular of having a portion of that weight to the rear of neck portion 71, is that the backswing need not be as high in order to create a certain level of kinetic energy at impact. The greater the weight, the less the backswing height needs to be for a particular level of kinetic energy and thus the distance of travel of the clubhead on its downswing is less, and the putter is easier to control.

Figure 5:
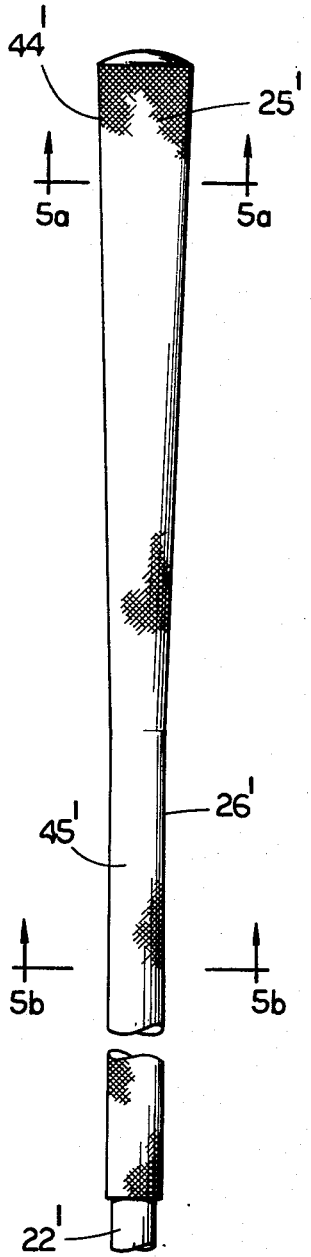
FIG. 5 is a front view of an alternate gripping arrangement associated with the FIG. 1 golf putter.
Figure 5A:
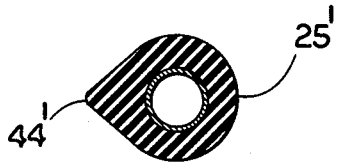
FIG. 5*a* is a sectional view of the FIG. 5 gripping arrangement taken along line 5*a*—5*a* in FIG. 5.
Figure 5B:
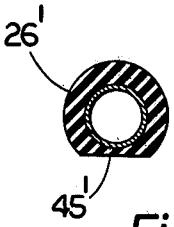
FIG. 5*b* is a sectional view of the FIG. 5 gripping arrangement taken along line 5*b*—5*b* in FIG. 5.

Although the embodiment shown by FIGS. 1–4*a* disclose a golf putter having two gripping portions which are separate and apart from each other, the gripping means for the putter could equally well be a single gripping means having a finger-orienting ridge 44' disposed about its upper portion and a flat exterior surface 45' disposed about its lower portion as shown in FIGS. 5, 5*a* and 5*b*. These grip portions do not overlap each other such that the ridge is confined solely to the upper portion and the flat exterior surface is confined solely to the lower portion. Prime notations have been used for reference numerals 22, 25, 26, 44 and 45 in FIGS. 5, 5*a* and 5*b* in order to differentiate from the similar numbering scheme of FIGS. 1, 2, 3 and 4.

Also a part of this present invention, is the method of use of putter 20. FIGS. 6 and 7 show the user in the correct, substantially upright stance and with the correct grip for proper utilization of the club. Although shown for a right-handed golfer, this invention will work equally well for a left-hander. The upper gripping portion 25 is gripped with the left hand oriented by use of the finger-orienting ridge 44 to assure that the ball-striking surface 24 is perpendicular to the symmetry plane 40 in which the club swings and to axis plane 30. This upper gripping portion 25 is held adjacent to the golfer's right side, in front of his body and at a point approximately horizontal with the armpit, while in a bent and slightly forward position. With the right hand the golfer grips the lower gripping portion 26 so that the thumb of the right hand rests on the flat front exterior surface 45 which is in a plane normal to the symmetry plane 40. The axis of rotation of the putter is normal to symmetry plane 40 and coincident with the pivot point where the left hand holds the upper gripping portion. The golfer's head is bent slightly so that with the ball 46 out in front of the golfer; the golfer's right eye, right hand, golf ball 46 and intended path of travel 49 are all substantially in the same line 50 (see FIG. 7). The exact location of the right hand depends on the physical size and proportion of the golfer's body. Since the ball-striking surface 24 is perpendicular to this line, which coincides with plane 30, and with the intended path of travel 49 for ball 46, then virtually no eye contact with the ball is necessary during the swing in order to direct the ball's motion. The golfer, starting the swing at the initial position 51 (see FIG. 6) draws the clubhead 21 back with the right hand in a pendulum-type of motion pivoting at the point where the left hand grips the shaft. Depending upon the desired distance for the ball 46 to travel, the club is stopped at a second position 52 on the backswing which places the clubhead at a height 53 above the ground. When the club is released with the right hand the clubhead weight acted on by gravity accounts for the downward swing to the position of impact 54 where clubhead kinetic energy is imparted to the ball 46 causing it to roll along the intended path 49. The clubhead then finishes in the final position 55 as part of its follow through. Due to the clubhead geometry, the clubhead face attitude at impact, and the follow through; a topspin is imparted to the ball. The thumb of the right hand resting on the flat exterior surface 45 guides the clubhead on its downswing to assure perpendicular contact between ball-striking surface 24 and golf ball 46. Although different golfers will invariably use different stances when putting, prior to striking, the ball is positioned forward of a line drawn perpendicular to the intended path and intersecting the forwardmost projection of the golfer's feet.

It may be noted that in the above-described and illustrated embodiment, there is a slight forward slant of the ball-striking surface of from 1 degree to 8 degrees with respect to the primary longitudinal axis 32 when this axis is positioned in a true vertical arrangement. This is in contrast to the usual golf club which has a backward slanted club face which tends to open up the club face. The greater the degree of backward slant being used on clubs the greater the positive loft. Thus, the ball-striking surface of the clubhead of the present invention is referred to as having a negative loft.

While the invention has been illustrated and described in detail in the drawings and foregoing description, the same is to be considered as illustrative and not restrictive in character, it being understood that only the preferred embodiment has been shown and described and that all changes and mofifications that come within the spirit of the invention are desired to be protected.

What is claimed is:

1. A golf putter for putting in a modified croquet style which comprises:

an elongated shaft having upper and lower gripping means thereon and a primary longitudinal axis;

a clubhead connected to said elongated shaft, said clubhead having a rear surface, a substantially flat sole portion, a ball-striking surface substantially perpendicular to said sole portion and a vertical axis;

said vertical axis being perpendicular to said sole portion and lying within an axis plane which is perpendicular to said ball-striking surface, said axis plane being substantially coincident with the centerline of said ball-striking surface;

said ball-striking surface lying in a striking plane disposed at an angle of from 1 degree to 8 degrees with respect to said primary longitudinal axis and having zero loft when said substantially flat sole portion is substantially parallel with the ground; and said primary longitudinal axis being divergent from said axis plane by at least 10 degrees and intersecting said axis plane at a point above said clubhead.

2. The golf putter of claim 1 which further includes a neck portion integral with and extending from said rear surface and connecting said elongated shaft to said clubhead, the attachment of said neck portion to said rear surface being at a single location, the centerline of said location being substantially coincident with said axis plane.

3. The golf putter of claim 2 in which said clubhead has its center of gravity in said axis plane and said ball-striking surface is elongated in a direction perpendicular to said axis plane.

4. The golf putter of claim 3 in which said center of gravity is behind said ball-striking surface and said ball-striking surface is forward of the point of connection of said neck portion to said shaft.

5. The golf putter of claim 4 wherein said upper and lower gripping means are disposed on a single grip member having distinct grip portions, the upper grip portion including an exterior finger-orienting ridge pointed in a direction generally perpendicular to said axis plane, the lower grip portion including a substantially flat exterior surface disposed in a plane generally perpendicular to said axis plane, said ridge and said flat exterior surface being free of any overlap relative to each other.

6. The golf putter of claim 5 in which said upper grip portion is constructed of neoprene with a hardness of from 20 to 30 durometers.

7. The golf putter of claim 8 in which said lower grip portion is constructed of neoprene with a hardness of from 55 to 65 durometers.

8. The golf putter of claim 7 in which said golf putter is between 38 and 46 inches in length, measured along said vertical axis from said sole portion to a line which is perpendicular to said vertical axis and coincident with the free end of said shaft.

9. The golf putter of claim 8 in which said clubhead further comprises:

two end portions disposed on opposite sides of said vertical axis and having upwardly diverging sides; and said end portions each having a thickness between said rear surface and said ball-striking surface which gradually increases in an outwardly direction as said sides diverge upwardly.

10. The golf putter of claim 8 in which said clubhead further comprises:

an upright ball-striking portion including said ball-striking surface and having a rear surface opposite thereto;

a triangularly shaped protrusion having a wider end integrally connected to said rear surface and tapering to a narrower end as said protrusion extends rearwardly;

said sole comprising the underside of said upright ball-striking portion and the underside of said triangularly shaped protrusion;

a neck portion integrally joined to said triangularly shaped protrusion and extending upwardly to a point of attachment to said elongated shaft; and wherein a majority of said triangularly shaped protrusion between said rear surface and where said neck portion joins said protrusion is substantially reduced in thickness.

11. The golf putter of claim 4 in which said clubhead further comprises:

two end portions disposed on opposite sides of said vertical axis and having upwardly diverging sides; and said end portions each having a thickness between said rear surface and said ball-striking surface which gradually increases in an outwardly direction as said sides diverge upwardly.

12. The golf putter of claim 4 in which said clubhead further comprises:

an upright ball-striking portion including said ball-striking surface and having a rear surface opposite thereto;

a triangularly shaped protrusion having a wider end integrally connected to said rear surface and tapering to a narrower end as said protrusion extends rearwardly;

said sole comprising the underside of said upright ball-striking portion and the underside of said triangularly shaped protrusion;

a neck portion integrally joined to said triangularly shaped protrusion and extending upwardly to a point of attachment to said elongated shaft; and wherein a majority of said triangularly shaped protrusion between said rear surface and where said neck portion joins said protrusion is substantially reduced in thickness.

13. A golf putter having a shaft with a clubhead at one end gripping means adjacent the other end which comprises:

an elongated shaft having upper and lower gripping means thereon and a primary longitudinal axis;

a clubhead connected to said elongated shaft, said clubhead having a rear surface, a sole portion, a ball-striking surface substantially perpendicular to said sole portion, and a vertical axis;

a neck portion integral with and extending from said rear surface and connecting said elongated shaft to said clubhead, the attachment of said neck portion to said rear surface being at a single location;

said vertical axis being perpendicular to said sole portion and lying within an axis plane which is perpendicular to said ball-striking surface;

said ball-striking surface lying in a striking plane disposed at an angle of 4 degrees with respect to said primary longitudinal axis;

said primary longitudinal axis being divergent from said axis plane by 10 degrees;

said clubhead has its center of gravity in said axis plane and said ball-striking surface is elongated in a direction perpendicular to said axis plane;

said center of gravity is behind said ball-striking surface and said ball-striking surface is forward of the point of connection of said neck portion to said shaft; and said upper and lower gripping means are disposed on a single grip member having distinct grip portions, the upper grip portion including an exterior finger-orienting ridge pointed in a direction generally perpendicular to said axis plane, the lower grip portion including a substantially flat exterior surface disposed in a plane generally perpendicular to said axis plane.

14. The golf putter of claim 13 in which said upper gripping means is constructed of neoprene with a hardness of from 20 to 30 durometers.

15. The golf putter of claim 14 in which said lower gripping means is constructed of neoprene with a hardness of from 55 to 65 durometers.

16. The golf putter of claim 15 in which said clubhead further comprises:

two end portions disposed on opposite sides of said vertical axis and having upwardly diverging sides; and said end portions each having a thickness between said rear surface and said ball-striking surface which gradually increases in an outwardly direction as said sides diverge upwardly.

17. The golf putter of claim 15 in which said clubhead further comprises:

an upright ball-striking portion including said ball-striking surface and having a rear surface opposite thereto;

a triangularly shaped protrusion having a wider end integrally connected to said rear surface and tapering to a narrower end as said protrusion extends rearwardly;

said sole comprising the underside of said upright ball-striking portion and the underside of said triangularly shaped protrusion;

a neck portion integrally joined to said triangularly shaped protrusion and extending upwardly to a point of attachment to said elongated shaft; and wherein a majority of said triangularly shaped protrusion between said rear surface and where said neck portion joins said protrusion is substantially reduced in thickness.

18. A clubhead for use with a modified croquet-style putter which comprises:

a substantially flat ball-striking surface having an outer end and an inner end;

a top surface;

a rear surface;

a sole portion extending between said ball-striking surface and said rear surface and being substantially perpendicular to said ball-striking surface;

a vertical axis perpendicular to said sole portion and lying within said ball-striking surface;

a neck portion integrally connected to said rear surface and having a free end extending upwardly therefrom; and said neck portion being sent into a suitable configuration such that when said free end is joined to a straight shaft, the primary longitudinal axis of said straight shaft diverges from said vertical axis by at least 10 degrees and is disposed at an angle with respect to said ball-striking surface of from 1 degree to 8 degrees and said primary longitudinal axis intersects the top surface at a location between said ball-striking surface and said rear surface and between said vertical axis and said outer end.

19. The clubhead of claim 18 which further comprises an outer portion and an inner portion disposed on opposite sides of said vertical axis and having edges which diverge upwardly from said sole portion to said top surface.

20. The clubhead of claim 19 in which the thickness of said outer portion and said inner portion between said rear surface and said ball-striking surface gradually increases in an outwardly direction as said edges diverge upwardly.

21. A golf putter for putting in a modified croquet style which comprises:

an elongated shaft having upper and lower gripping means thereon and a primary longitudinal axis;

a clubhead having a rear surface, a ball-striking surface, a sole portion between said rear surface and said ball-striking surface, a top surface between said rear surface and said ball-striking surface and a vertical axis which is substantially coincident with the centerline of said ball-striking surface;

a neck portion integral with and extending from said rear surface of said clubhead and connecting said clubhead to said elongated shaft, said neck portion being contoured so as to orient said elongated shaft such that said primary longitudinal axis intersects the top surface of said clubhead at a location behind said ball-striking surface and between said vertical axis and the outermost end of said clubhead;

said vertical axis being perpendicular to said sole portion and lying within an axis plane which is perpendicular to said ball-striking surface;

said ball-striking surface lying in a striking plane disposed at an angle of from 1 degree to 8 degrees with respect to said primary longitudinal axis; and said primary longitudinal axis being divergent from said axis plane by at least 10 degrees.

22. The golf putter of claim 21 wherein said neck portion attaches to said rear surface at a single location, the centerline of said location being substantially coincident with said axis plane, said clubhead having its center of gravity in said axis plane and said ball-striking surface being elongated in a direction perpendicular to said axis plane.

23. The golf putter of claim 22 wherein said upper and lower gripping means are disposed on a single grip member having distinct grip portions, the upper grip portion including an exterior finger-orienting ridge pointed in a direction generally perpendicular to said axis plane, the lower grip portion including a substantially flat exterior surface disposed in a plane generally perpendicular to said axis plane.

* * * * *

UNITED STATES PATENT AND TRADEMARK OFFICE

CERTIFICATE OF CORRECTION

PATENT NO. : 4,163,554

DATED : August 7, 1979

INVENTOR(S) : Floyd V. Bernhardt

It is certified that error appears in the above-identified patent and that said Letters Patent are hereby corrected as shown below:

In column 5, line 38, please change "shell" to --shall--.

In column 5, line 47, please change "Bell-striking" to --Ball-striking--.

In column 10, line 25, please change the number "8" to --6--.

In column 11, line 23, after the word "end" and before the word "gripping" please insert the word --and--.

In column 12, line 39, please change the word "sent" to --bent--.

Signed and Sealed this

*Eighteenth* Day of *December 1979*

[SEAL]

*Attest:*

SIDNEY A. DIAMOND

*Attesting Officer*

*Commissioner of Patents and Trademarks*